US009151117B2

(12) United States Patent
Connell

(10) Patent No.: US 9,151,117 B2
(45) Date of Patent: Oct. 6, 2015

(54) MEDIA PRESSURE CAVITATION PROTECTION SYSTEM FOR ROCK DRILLS

(75) Inventor: Stuart A. Connell, Sherman, TX (US)

(73) Assignee: Caterpillar Global Mining LLC, Oak Creek, WI (US)

( * ) Notice: Subject to any disclaimer, the term of this patent is extended or adjusted under 35 U.S.C. 154(b) by 531 days.

(21) Appl. No.: 13/601,292

(22) Filed: Aug. 31, 2012

(65) Prior Publication Data

US 2014/0060932 A1 Mar. 6, 2014

(51) Int. Cl.
*E21B 7/02* (2006.01)

(52) U.S. Cl.
CPC ..... *E21B 7/022* (2013.01)

(58) Field of Classification Search
CPC ..... E21B 7/022; E21B 44/02; E21B 44/06
See application file for complete search history.

(56) References Cited

U.S. PATENT DOCUMENTS 5,129,464 A 7/1992 Richier
7,198,117 B2 4/2007 Uitto
7,231,989 B2 6/2007 Salminen et al.
7,267,182 B2 9/2007 Saha
2001/0047873 A1 12/2001 Kaneko
2008/0300698 A1* 12/2008 Havekost et al. ..... 700/83
2010/0101862 A1* 4/2010 Leu et al. ..... 175/40
2011/0024189 A1* 2/2011 Saeed et al. ..... 175/40

* cited by examiner

*Primary Examiner* — William P Neuder
(74) *Attorney, Agent, or Firm* — Foley & Lardner LLP

(57) ABSTRACT

A drilling apparatus has a chassis and a feed beam. The feed beam includes a rock drill hammer, a moveable drill string, a rock drill system coupled to the feed beam, a media pressure system coupled to the rock drill system, and a sensor system. The media pressure system includes a high pressure supply path, a low pressure return path, a control valve coupled to the high pressure supply path, at least one accumulator, and a sensor system. The sensor system includes a pressure transducer coupled to the high pressure supply path, the low pressure return path, or the accumulator to supply pressure data, a control unit configured to monitor and compare the pressure data to an acceptable pressure range stored in memory, and a warning apparatus configured to alert the operator of a pressure outside of the predetermined acceptable pressure range.

19 Claims, 3 Drawing Sheets

MEDIA PRESSURE CAVITATION PROTECTION SYSTEM FOR ROCK DRILLS

TECHNICAL FIELD

The present disclosure relates generally to the field of pressure sensor systems for preventing media pressure cavitation in rock drills.

BACKGROUND

This section is intended to provide a background or context to the invention recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

A hydraulic drilling apparatus has an internal, oscillating hammer that is accelerated and decelerated at high rates of speed by means of shifting media (e.g. hydraulic, pneumatic, etc.) pressure. The shifting media pressure acting on differential areas of the hammer and shuttle valve causes the movement required for oscillation. The movement of the hammer is typically driven by hydraulic or pneumatic flow in a system that has a high pressure media supply path and a low pressure return path for the shifting media entry and exit of the hammer. The media supply and return circuits typically have one or more accumulators in the supply and return paths, which are usually mounted directly onto the drilling apparatus. The accumulator is intended to dampen peak pressure surges that are inherent in media systems, as well as provide a boost of media flow to the system if the flow from the primary pump is not adequate at a given time in the hammer oscillation cycle. The accumulator typically includes a diaphragm that separates hydraulic or pneumatic fluid from the accumulator charging media (e.g., nitrogen gas).

However, certain challenges are presented in such systems. For example, nitrogen gas may leak from the accumulator to the outside environment, such as through an improperly seated charge valve. Also, most flexible diaphragms are permeable and gas can pass through them over time. Also, if the accumulator diaphragm is torn or has a hole in it, the nitrogen gas may leak into the fluid system. Further, the accumulators are charged to a specific pressure range based on a percentage of the supply and return circuit pressures. If the accumulators are over or under charged, shifting media flow may not be adequate for the proper operation of the drilling apparatus. Still further, the operator of the drill unit or service personnel can lower the media supply and return pressure of the drilling apparatus itself causing the accumulators to be out of specification in comparison to the accumulator settings.

If the charging media in the accumulators leaks into the driving media or into the outside environment, or if the accumulators are incorrectly charged, an insufficient pressure may be exerted by the accumulator. When the flow in such a system is insufficient to fill the changes in volumetric requirements, a negative pressure may occur (e.g., a vacuum) resulting in cavitation. Cavitation may cause undesirable hammer movement and speeds which may cause the hammer to overstroke and impact other internal mechanical components ultimately resulting in overstressed parts which may lead to failures. Because the hammer is usually located at a distance away from the operator, the operator may not be aware if the accumulator(s) lose a charge or are otherwise over or under charged for providing the proper operational supply and return pressure for the hammer.

SUMMARY OF THE INVENTION

One embodiment of the disclosure relates to a drilling apparatus having a chassis and a feed beam coupled to the chassis via a boom. The feed beam includes a rock drill hammer, a drill string that is moveable relative to the feed beam, a rock drill system coupled to the feed beam, a media pressure system coupled to the rock drill system, and a sensor system. The feed beam is configured to apply a feed force to the drill string. The media pressure system for the drilling apparatus includes at least one high pressure supply path, at least one low pressure return path, a control valve coupled to the high pressure supply path, and at least one accumulator. The sensor system includes a pressure transducer coupled to one of the high pressure supply path, the low pressure return path, or the accumulator and configured to supply pressure data, a control unit configured to monitor the pressure data and compare the pressure data to an acceptable pressure range stored in memory, and a warning apparatus configured to alert the operator of a pressure outside of the predetermined acceptable pressure range.

Another embodiment of the disclosure relates to a sensor apparatus for a drilling apparatus and includes a pressure transducer configured to sense a pressure in a media pressure system and provide pressure data representative of the pressure in the media pressure system, the media pressure system comprising at least one accumulator, a wireless transceiver coupled to the pressure transducer, a control unit comprising readable memory, a wireless transceiver coupled to the control unit, and a warning apparatus. The control unit monitors the pressure data, compares the pressure data to an acceptable pressure range stored in the readable memory, and activates the warning apparatus to provide an alert of a pressure outside of a predetermined acceptable pressure range.

A further embodiment of the disclosure relates to a method for providing a media pressure cavitation protection system for a drilling apparatus. The method includes providing pressure sensors operable to generate pressure data associated with the components of a media pressure system of the drilling apparatus, the media pressure system including at least one accumulator, providing a data transmitter operable to transmit the pressure data to a computing device, the computing device operable to compare the pressure data to pressure ranges and to determine if a fault condition associated with the pressure ranges occurs, and providing a warning apparatus operable to provide an alert when the fault condition occurs.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Referring in general to the FIGURES, a sensor system for a media pressure drilling apparatus includes a pressure transducer, a wireless sending unit, a receiving unit, a programmable logic controller (PLC), and one or more media pressure transducers to monitor and alert the operator of improper accumulator charges as it is compares to existing media pressure drilling apparatus supply and return pressures.

Figure 1:
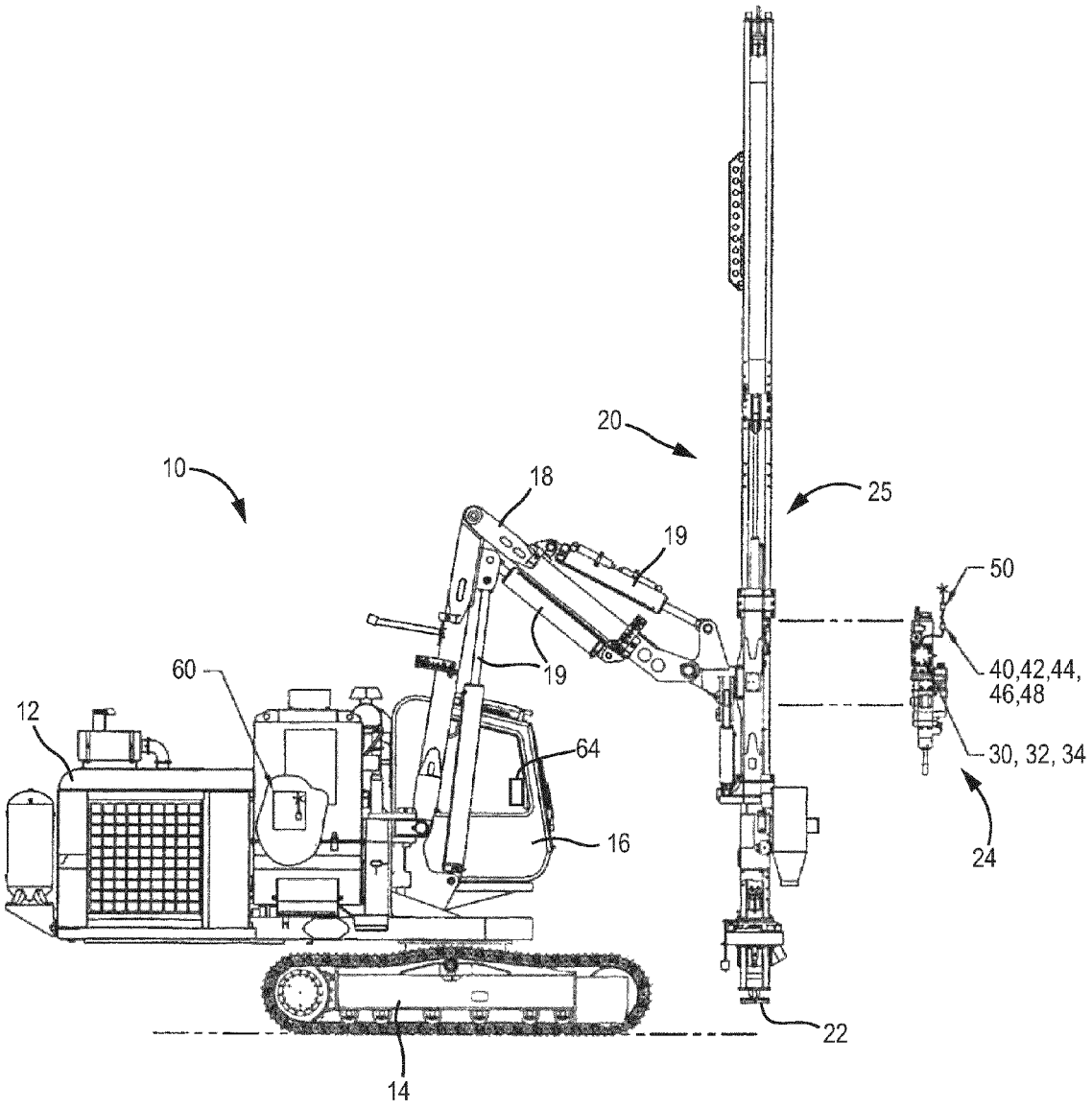
FIG. 1 is a schematic side view of a drilling apparatus including a remote pressure sensor system, in accordance with an exemplary embodiment.

Referring to FIG. 1, a hydraulic drilling apparatus 10 (e.g., drifter, etc.) is shown according to an exemplary embodiment. The drilling apparatus 10 is utilized to drill holes into a hard substance such as rock with a combination of a percussive system and a rotating system. In one embodiment, the drilling apparatus 10 is a self-propelled vehicle including a chassis 12 supported on a drive unit 14. The chassis 12 includes an operator compartment or cab 16. The drive unit 14 is shown as including a continuous track or caterpillar track. In other embodiments, the crawler unit may include wheels or a combination of wheels and tracks. In still other embodiments, the drilling apparatus 10 may instead be towed or otherwise moved by another vehicle.

The drilling apparatus 10 further includes a feed beam 20 (e.g., base, body, etc.) coupled to the chassis 12 with a boom 18, as shown in FIG. 1. The boom 18 may be an articulated arm or extension boom that is manipulated with actuators such as hydraulic cylinders 19. The feed beam 20 can be positioned through the repositioning of the boom 18 and the rotation of the chassis 12 (e.g., by rotating the chassis 12 relative to the drive unit 14). A drill string 22 is coupled to a rotating shaft and mounted at an end of the feed beam 20. The feed beam 20 advances the drill string 22, pressing it against a formation or material (e.g., rock) to be drilled. A rotary percussive system including a hammer 24 is mounted to the feed beam 20 via a slide 25. The oscillating hammer piston strikes a striking bar or shank that transmits the kinetic energy in the form of an impact or stress wave that travels down the drill string 22 to the drill bit 22 and ultimately to the formation or material being drilled. The percussive force (e.g., hammering, impact, etc.) and the rotational movement of the drill string 22 are intended to break the rock and drill a hole into the rock. The fragmented rock may then be flushed from the drilled hole with a fluid such as water or a compressed gas.

Figure 2:
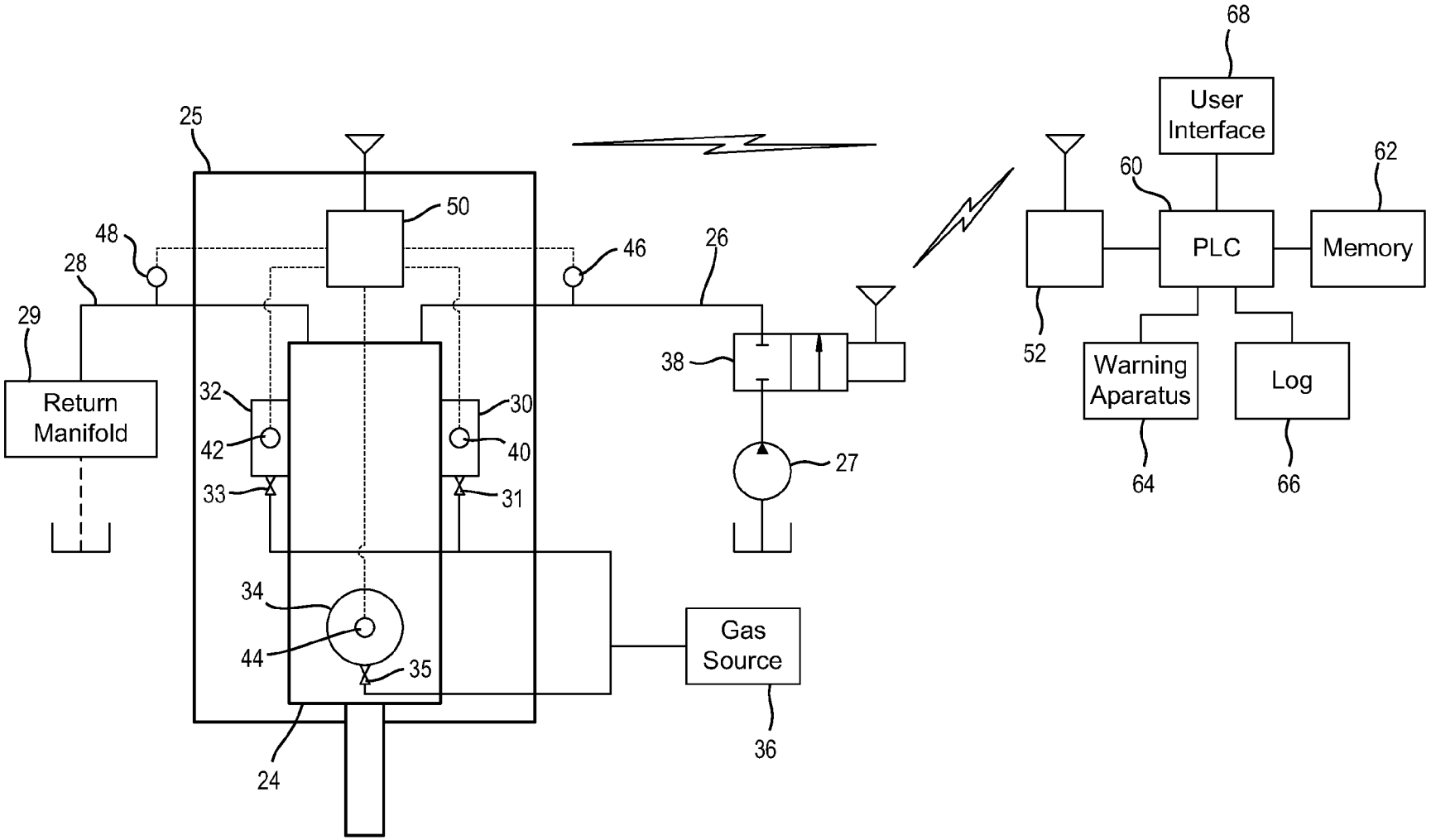
FIG. 2 is a schematic block diagram of a remote pressure sensor system for the drilling apparatus of FIG. 1, in accordance with an exemplary embodiment.

Referring to FIG. 2, the internal piston of the hammer 24 is coupled to a media pressure system and is accelerated and decelerated in an oscillating (e.g., reciprocating) pattern. The movement of the internal piston of the hammer 24 is driven by media flow in a system with a media actuator that has a high pressure media supply path 26 and a low pressure return path 28. High pressure media is provided to the hammer 24 through the supply path 26 by a device such as a pump 27. Low pressure media is returned by the return path 28 to a reservoir through a return manifold 29. The frequency of the hammer 24 oscillations may be varied for different drilling apparatus models, according to exemplary embodiments.

A negative pressure or vacuum may develop if the media flow in the supply path 26 is insufficient to fill the volumetric change in the actuator resulting from the displacement of the internal piston of the hammer 24. The vacuum may result in cavitation, which can cause undesirable hammer 24 movement and speeds, which may cause the internal piston of the hammer 24 to over-stroke and impact other internal mechanical components.

Accumulators (e.g., pressure storage devices, etc.) may be installed into the media paths 26 and 28 in the supply and return circuits to reduce the likelihood of inadequate or excessive pressures. In one embodiment, the accumulators are nitrogen-pressurized accumulators that include a flexible membrane or diaphragm that separates the media from a charging media, such as nitrogen gas. According to an exemplary embodiment, the feed beam 20 includes a first accumulator 30 coupled to the high pressure supply path 26, a second accumulator 32 coupled to the low pressure return path 28, and a third accumulator 34 coupled to a reflected energy dampening system. The accumulators 30, 32, and 34 may be coupled directly onto the hammer 24 or to the feed beam 20 proximate to the hammer 24 (see FIG. 1). Each of the accumulators 30, 32, and 34 includes a charge valve 31, 33, and 35, respectively. The charge valves 31, 33, and 35 are opened to allow the accumulators 30, 32, and 34 to be charged with gas from a source 36 (e.g., a nitrogen gas source). The charge valves 31, 33, and 35 are then closed to seal the accumulator charges.

The accumulators 30, 32, and 34 are intended to dampen peak pressure surges that are inherent in media pressure systems by absorbing the pressure and providing a boost to the media flow by releasing flow to compensate for periods when the flow from the primary pump 27 may not be adequate at a given time in the oscillation cycle of the hammer 24. The additional media flow supplied by the accumulators 30, 32, and 34 is desirable for the proper operation of the hammer 24 by avoiding instances of low pressure induced cavitation.

Pressure transducers 40, 42, 44, 46, and 48 are provided to sense the pressures of the charges in the accumulators 30, 32, and 34 and in the supply path 26 and the return path 28. According to an exemplary embodiment, a first pressure transducer 40 is coupled to the first accumulator 30 to sense the charge in the first accumulator 30, a second pressure transducer 42 is coupled to the second accumulator 32 to sense the charge in the second accumulator 32, a third pressure transducer 44 is coupled to the third accumulator 34 to sense the charge in the third accumulator 34, a fourth pressure transducer 46 is coupled to the high pressure supply path 26, and a fifth pressure transducer 48 is coupled to the low pressure return path 28. The transducers 46 and 48 sense the media supply and return pressures on the hammer 24 itself.

The pressure transducers 40, 42, 44, 46, and 48 are coupled to one or more transmitters 50 (e.g., sending units, etc.) that are configured to relay signals representative of the sensed pressure data from the transmitters 50 to a control unit. According to an exemplary embodiment, the control unit is a computing device, such as an on-board programmable logic controller (PLC) 60. The transmitters 50 may be mounted on vibration reducing isolators onto or near the hammer 24 itself (e.g., mounted to one of the accumulators 30, 32, or 34) or to the slide 25. As shown in FIGS. 1 and 2, the transmitter 50 may be a wireless transmitter that communicates wirelessly with a transceiver 52 coupled to the PLC 60. A wireless connection between the transducers 40, 42, 44, 46, and 48 and the PLC 60 is intended to minimize the use of hoses and wires that may break or leak during normal use of the drilling apparatus 10. However, in another embodiment, the signals from the transducers 40, 42, 44, 46, and 48 may be communicated to the PLC 60 with a wired connection (e.g., via a wire harness that extends along the feed beam 20, the boom 18, and the chassis 12). A wired connection may be used if, for example, if safety or security concerns or concerns of electromagnetic interference make a wireless connection undesirable.

The PLC 60 (e.g., an existing PLC for the drilling apparatus 10, etc.) monitors the pressure data from the transducers 40, 42, 44, 46, and 48 to calculate the media supply pressure (SP), the media return pressure (RP) and the three different accumulator nitrogen pre-charge ranges operating in the respective circuits. The PLC 60 is programmed to average the pressure data from each of the transducers 40, 42, 44, 46, and 48 over a time period. In an exemplary embodiment, the PLC 60 uses thirty seconds of actual drilling data recorded to establish a time average for analysis. The recorded average pressure data from the accumulators 30, 32, and 34 is compared to a target pressure range calculated by the PLC 60 for the desired operation of the drilling apparatus 10. The relation between the recorded average pressure data and the calculated target ranges is utilized to identify a fault condition and alert the operator of the vehicle of a fault condition or to directly control the media pressure system of the drilling apparatus 10.

In one embodiment, the nitrogen pre-charge for the accumulators 30 is intended to be between 30 percent and 40 percent of the circuit pressure for the media path to which the accumulator is coupled (e.g., the supply path 26 pressure for the first accumulator 30 or the return path 28 pressure for the second accumulator 32). An exemplary supply path (SP) pressure is given as 2550 psi and a return path pressure (RP) as 150 psi. An additional 6 percent may be allowed either above 40 percent or below 30 percent, according to one embodiment. This will be referred to as the target range and is calculated with the following equations:

$$SP_{max}=(SP\times 0.4)\times(1.06)$$

$$SP_{min}=(SP\times 0.3)\times(0.94)$$

$$RP_{max}=(RP\times 0.4)\times(1.06)$$

$$\mathrm{RP}_{min}=(\mathrm{RP}\times 0.3)\times(0.94)$$

The target ranges may be stored in memory 62. The PLC 60 establishes different pressure ranges based on the target pressure ranges. These ranges will be referred to as acceptable ranges, warning ranges, and stop ranges. A first acceptable maximum range is established at less than or equal to the maximum of either SP or RP accumulator settings and a second acceptable minimum range is established at greater than or equal to the minimum of either SP or RP accumulator settings. In an exemplary embodiment, the first acceptable maximum range is 16 percent above the maximum target pressure and the second acceptable minimum range is 16 percent below the minimum target pressure. The acceptable range is calculated with the following equations:

$$SP_{acceptable,max}=(SP\times 0.4)\times(1.16)$$

$$SP_{acceptable,min}=(SP\times 0.3)\times(0.84)$$

$$RP_{acceptable,max}=(RP\times 0.4)\times(1.16)$$

$$RP_{acceptable,min}=(RP\times 0.4)\times(0.84)$$

A first warning range is greater than the first acceptable range and a second warning range is less than the second acceptable range. In an exemplary embodiment, the first warning range is established at 31 percent above the target range and the second warning range is established at 31 percent below the target range. The warning range is calculated with the following equations:

$$SP_{warning,max}=(SP\times 0.4)\times(1.31)$$

$$SP_{warning,min}=(SP\times 0.3)\times(0.69)$$

$$RP_{warning,max}=(RP\times 0.4)\times(1.31)$$

$$RP_{warning,min}=(RP\times 0.4)\times(0.69)$$

A first stop range is greater than the first warning range and a second stop range is less than the second warning range.

The PLC 60 compares the recorded average pressure data to the calculated target range to establish in which pressure range each of the accumulators 30, 32, and 34 are operating. The PLC 60 instructs a warning apparatus 64 to give feedback indicating the severity of any out-of-specification ranges. In one embodiment, the warning apparatus 64 is a screen, a light, or an array of lights. The warning apparatus 64 may give no feedback if the accumulators 30, 32, and 34 are in the target range, operating within the first acceptable maximum range, or the second acceptable minimum range. The warning apparatus 64 may indicate a minor alert if an accumulator is in the first or the second warning range with a yellow flashing light or a yellow alert on an operator panel (e.g., "Caution HP Accumulator Fault"). The warning apparatus 64 may indicate a major alert if an accumulator is in the first or the second stop range with a red flashing light or a red alert on an operator panel (e.g., "Stop HP Accumulator Fault"). The warning apparatus 64 may also include additional devices to provide other feedback to the operator. For example, the warning apparatus 64 may give audio feedback (e.g., a tone, buzzer, etc.) if any of the accumulators 30, 32, or 34 are in a warning or a stop pressure range.

In addition to providing feedback to the operator of the drilling apparatus 10, the PLC 60 may further directly control the media pressure system to avoid damage to the drilling apparatus 10 due to an overcharged or undercharged accumulator. For example, in one embodiment, if one of the accumulators 30, 32, or 34 operates in a stop range for a predetermined length of time, the PLC 60 may be programmed to communicate with a control valve 38 either wirelessly or via a wired connection and shut down the media pressure system by closing a control valve 38.

If no fault conditions exist (e.g., if the accumulators 30, 32, and 34 are all operating in the predetermined range or the acceptable range) then the pressure data from the transducers 40, 42, 44, 46, and 48 may be dumped or erased. If, however a fault condition is experienced, then the PLC 60 may be programmed to keep a record of faults that occur, whether minor faults from the accumulators operating in the warning ranges or major faults from the accumulators operating in the stop ranges. In one embodiment, the PLC 60 may allow the operator to acknowledge fault and record the acknowledgement instance in a log 66. Additional data may also be stored in the log 66, such as a date and time stamp as well as the out-of-specification limits at the time of the original alert (s). The PLC 60 may allow the resetting of the alerts once the accumulators have been serviced by a qualified technician. For example, the technician may enter an unlock code via a user interface 68 after the accumulator pre-charge faults have been corrected. The unlock code may instruct the PLC 60 to allow operation of the media pressure system by opening the control valve 38.

In another embodiment, the PLC 60 may not record data in a log. Instead, the PLC 60 may compare a snapshot of the pressures utilizing the data from the transducers 40, 42, 44, 46, and 48. The PLC 60 may then alert an operator of fault conditions with the warning apparatus 64 and/or operate the control valve 38, as described above.

In another embodiment, the functions of the PLC 60 may be carried out by another suitable computing device. For example, a computer separate from the vehicle PLC may be utilized to receive data from the transducers 40, 42, 44, 46, and 48; calculated the pressure ranges; initiate and monitor alerts; and control the media pressure system for the drilling apparatus 10.

Figure 3:
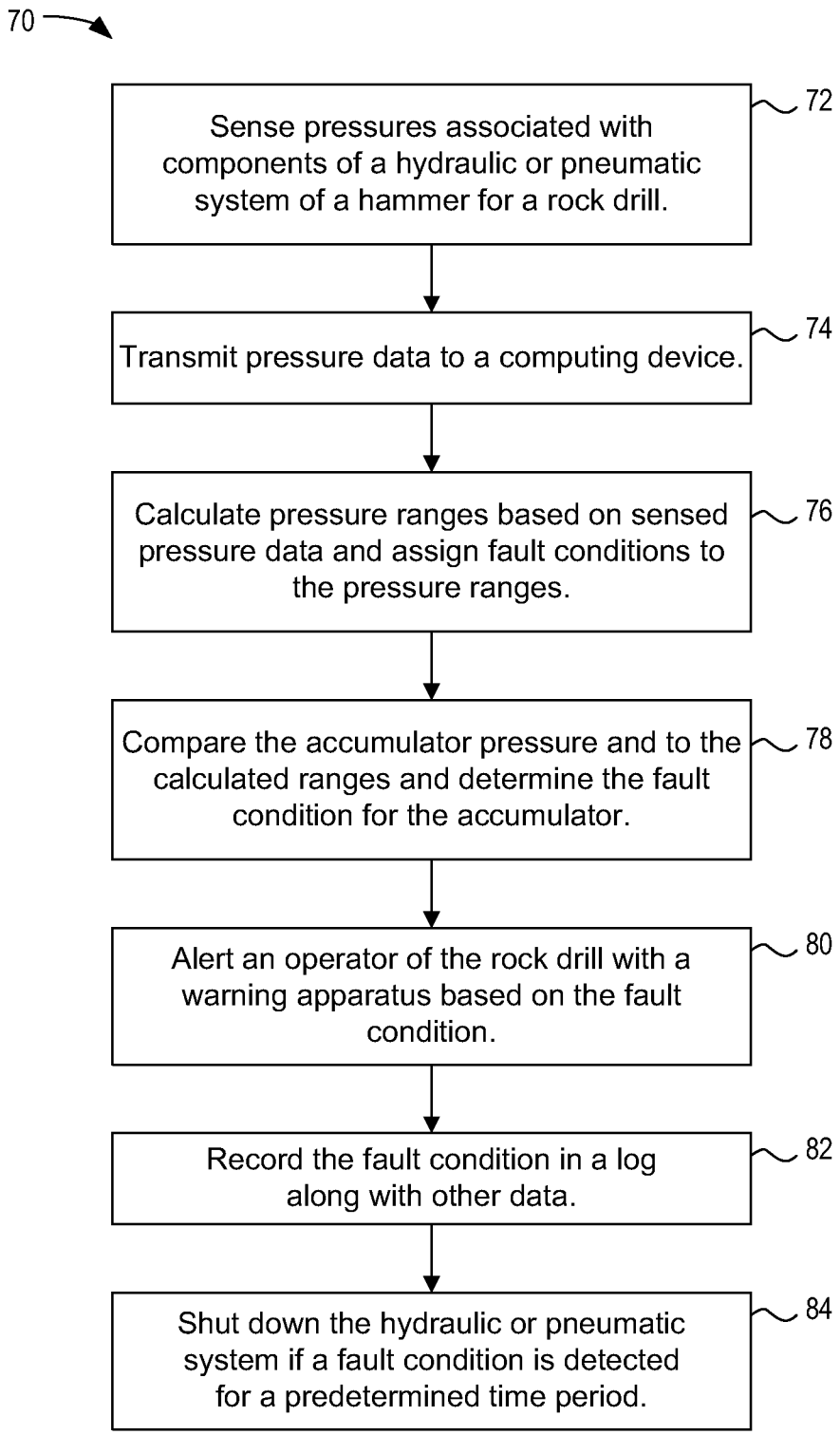
FIG. 3 is a flowchart of a method for operating the drilling apparatus of FIG. 1, in accordance with an exemplary embodiment.

Referring to FIG. 3, a flowchart of a method 70 for monitoring and operating a drilling apparatus 10 with a hammer 24 including a media pressure system is shown according to an exemplary embodiment. The pressures of the media pressure system supply path 26, the return path 28, and the accumulators 30, 32, and 34 are sensed, such as with pressure transducers 40, 42, 44, 46, and 48 (step 72). The pressure data is then transmitted to a computing device, such as the PLC 60 (step 74). The computing device calculates various pressure ranges for the accumulators 30, 32, and 34 based on the sensed pressure of the associated media paths and assigns a fault condition to the pressure ranges (step 76). The pressures of each of the accumulators 30, 32, and 34 are compared to the calculated pressure ranges to determine the fault conditions for the accumulators 30, 32, and 34. The computing device then instructs a warning apparatus 64 to alert an operator of the drilling apparatus 10 based on the fault conditions (step 80). The computing device may then record the fault condition in a log along with other data, such as the date and time, the out-of-specification limits at the time of the fault, and an acknowledgment of the operator (step 82). The computing device may then shut down the media pressure system with the control valve 38 if a fault condition is detected for a predetermined time period (step 84).

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

It should also be noted that any references to "lateral," "right," and "left" in this description are merely used to identify the various elements as they are oriented in the FIGURES, with "right," "left," and "lateral" being relative to a specific direction. These terms are not meant to limit the element which they describe, as the various elements may be oriented differently in various applications.

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It should be noted that the orientation of various elements may differ according to other exemplary embodiments, and that such variations are intended to be encompassed by the present disclosure.

The construction and arrangements of the remote pressure sensor for a drilling apparatus, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

INDUSTRIAL APPLICABILITY

The disclosed drilling apparatus may be utilized in any drilling application where media pressure is used to generate movement. The disclosed drilling apparatus may help to reduce charging media (e.g., nitrogen gas) leaks into the driving media or into the outside environment. Accumulators are charged to a specific pressure range based on a percentage of the supply and return circuit pressures. If the accumulators are not charged properly, the shifting media flow may not be adequate. The disclosed drilling apparatus may help to keep the accumulators properly charged and the drilling apparatus running properly.

If charging media in the accumulators leaks into the driving media or into the outside environment, or if the accumulators are incorrectly charged, an insufficient pressure may be exerted by the accumulator. When the flow in such a system is insufficient to fill the changes in volumetric requirements, a negative pressure may occur, resulting in cavitation. Cavitation may cause undesirable movement and speed of the drilling apparatus, and the disclosed drilling apparatus may reduce cavitation within a media pressure system.

It will be apparent to those skilled in the art that various modifications and variations can be made to the disclosed drilling apparatus. Other embodiments will be apparent to those skilled in the art from consideration of the specification and practice of the disclosed drilling apparatus. It is intended that the specification and examples be considered as exemplary only, with a true scope being indicated by the following claims and their equivalents.

What is claimed is:

1. A drilling apparatus, comprising:

a chassis;

a feed beam coupled to the chassis via a boom the feed beam comprising:

a rock drill hammer;

a drill string moveable relative to the feed beam;

a rock drill system coupled to the feed beam;

a media pressure system coupled to the rock drill system, comprising:

at least one high pressure supply path;

at least one low pressure return path;

a control valve coupled to the high pressure supply path; and at least one accumulator; and a sensor system, comprising:

a pressure transducer coupled to one of the high pressure supply path, the low pressure return path, or the accumulator and configured to supply pressure data;

a control unit configured to monitor the pressure data and compare the pressure data to an acceptable pressure range stored in memory; and a warning apparatus configured to alert the operator of a pressure outside of the predetermined acceptable pressure range;

wherein said feed beam is configured to apply a feed force to said drill string.

2. The drilling apparatus of claim 1, wherein the control unit is provided on the chassis.

3. The drilling apparatus of claim 2, wherein the sensor system further comprises a wireless sending unit coupled to the pressure transducer and a wireless receiving unit coupled to the control unit.

4. The drilling apparatus of claim 1, wherein the control unit calculates an average pressure based on the pressure data received from the pressure transducer over a period of time.

5. The drilling apparatus of claim 3, wherein the control unit further comprises a first warning pressure range and a second warning pressure range stored in memory, the first warning pressure range being less than the acceptable pressure range and the second warning pressure range being greater than the acceptable pressure range.

6. The drilling apparatus of claim 5, wherein the control unit further comprises a first stop pressure range and a second stop pressure range stored in memory, the first stop pressure range being less than the first warning pressure range and the second stop pressure range being greater than the second warning pressure range.

7. The drilling apparatus of claim 6, wherein the control unit is operably coupled to the control valve.

8. The drilling apparatus of claim 7, wherein the control unit is configured to close the control valve if the pressure sensed by the pressure transducer is in the first stop pressure range or the second stop pressure range for a predetermined length of time.

9. The drilling apparatus of claim 6, wherein the control unit records a fault condition in a log with a date and time stamp if the pressure sensed by the pressure transducer is in one of the first warning pressure range, the second warning pressure range, the first stop pressure range, or the second stop pressure range for a predetermined length of time.

10. A sensor apparatus for a drilling apparatus, comprising:

a pressure transducer configured to sense a pressure in a media pressure system and provide pressure data representative of the pressure in the media pressure system, the media pressure system comprising at least one accumulator;

a wireless transceiver coupled to the pressure transducer;

a control unit comprising readable memory;

a wireless transceiver coupled to the control unit; and a warning apparatus;

wherein the control unit monitors the pressure data, compares the pressure data to an acceptable pressure range stored in the readable memory, and activates the warning apparatus to provide an alert of a pressure outside of a predetermined acceptable pressure range;

wherein the control unit calculates an average pressure based on the pressure data received from the pressure transducer over a period of time.

11. The sensor apparatus of claim 10, wherein the control unit further comprises a first warning pressure range and a second warning pressure range stored in memory, the first warning pressure range being less than the acceptable pressure range and the second warning pressure range being greater than the acceptable pressure range.

12. The sensor apparatus of claim 11, wherein the control unit further comprises a first stop pressure range and a second stop pressure range stored in memory, the first stop pressure range being less than the first warning pressure range and the second stop pressure range being greater than the second warning pressure range.

13. The sensor apparatus of claim 12, wherein the control unit is coupled to a control valve that is configured to allow or stop the operation of the media pressure system.

14. The drilling apparatus of claim 13, wherein the control unit is configured to close the control valve to stop the media pressure system if the pressure sensed by the pressure transducer is in the first stop pressure range or the second stop pressure range.

15. A method for providing a media pressure cavitation protection system for a drilling apparatus, comprising:

providing pressure sensors operable to generate pressure data associated with the components of a media pressure system of the drilling apparatus, the media pressure system including at least one accumulator;

providing a data transmitter operable to transmit the pressure data to a computing device, the computing device operable to compare the pressure data to pressure ranges and to determine if a fault condition associated with the pressure ranges occurs; and providing a warning apparatus operable to provide an alert when the fault condition occurs.

16. The method of claim 15, further comprising recording the fault condition in a log, and deactivating the media pressure system if a fault condition is detected for a predetermined time period.

17. The method of claim 16, further comprising recording one of the date and time of the fault, an out-of-specification limit at the time of the fault, or an acknowledgment of the operator.

18. The method of claim 16, further comprising deactivating the media pressure system by closing a control valve.

19. The method of claim 16, wherein the media pressure system remains deactivated until the accumulator associated with the fault condition is serviced to resolve the fault condition.

* * * * *